United States Patent [19]

Kamo et al.

[11] Patent Number: 4,627,415

[45] Date of Patent: Dec. 9, 1986

[54] COOKING STOVE HAVING REMOVABLE TOP PLATE

[75] Inventors: Tetuo Kamo; Junichi Miyagawa; Kazuichi Okada; Eiji Shiota, all of Osaka, Japan

[73] Assignee: Matsushita Electric Industrial Co., Ltd., Japan

[21] Appl. No.: 794,783

[22] Filed: Oct. 31, 1985

[30] Foreign Application Priority Data

Nov. 2, 1984 [JP] Japan ..... 59-231512

[51] Int. Cl.[4] ..... F24C 15/20

[52] U.S. Cl. ..... 126/299 R; 126/300; 126/21 R; 126/211

[58] Field of Search ..... 126/21 R, 21 A, 211, 126/299 R, 299 D, 300, 214 R, 301, 41 R; 98/115 R, 115.1

[56] References Cited

U.S. PATENT DOCUMENTS

| | | | |
|---|---|---|---|
| 3,712,819 | 1/1973 | Field | 126/299 R |
| 3,853,115 | 12/1974 | Jenn | 126/299 R |
| 4,432,274 | 2/1984 | Kurotaki | 126/299 E |
| 4,562,827 | 1/1986 | Cerola | 126/300 |

*Primary Examiner*—James C. Yeung

*Attorney, Agent, or Firm*—Lowe, Price, Leblanc, Becker & Shur

[57] ABSTRACT

A cooking stove is provided with a top plate, for receiving cooking utensils, which can be easily and rapidly removed for servicing purposes, etc. The top plate is retained against the stove housing by a very simple catch mechanism at the front and is attached to the housing at the rear by means of screws, at a position adjacent to an air inlet/outlet aperture, with a cover of this aperture also serves to mask the screws, for improved appearance.

6 Claims, 4 Drawing Figures

COOKING STOVE HAVING REMOVABLE TOP PLATE

BACKGROUND OF THE INVENTION

The present invention relates to a cooking stove for use in a kitchen, etc, i.e. an electric cooking stove, a gas range, etc, and in particular to a cooking stove having a top plate with a flat surface for use as a cooking surface upon which cooking pans, etc. are placed to be heated by one or more heating elements disposed in the interior of the cooking stove beneath the top plate, such as high-frequency induction heating elements. The invention is especially applicable to a cooking stove of this type which is designed to fit within an aperture in a horizontally disposed top board of a unit of kitchen furniture, referred to in the following as a counter top. With prior art cooking stoves of this type, problems arise with regard to the means adopted for retaining the top plate of the stove in a fixed position. As described hereinafter, such means generally involve the use of screws which are visible from the exterior of the stove, and hence have an adverse effect upon the appearance of the stove, and also have the disadvantage that the upper part of the stove protrudes to a substantial extent above the upper surface of the counter top in which the cooking stove is fitted. In addition, it is necessary to remove all of the attachment screws in order to remove the top plate, when the interior of the cooking stove must be accessed for maintenance or other purposes, which is time-consuming and inconvenient.

It is an objective of the present invention to overcome the problems which arise with prior art arrangements for attaching the top plate of a cooking stove of the type described above, whereby the attachment means will not adversely affect the external appearance of the cooking stove, and will facilitate maintenance by enabling the top plate of the cooking stove to be rapidly removed.

SUMMARY OF THE INVENTION

In order to attain the objectives set out above, a cooking stove according to the present invention includes a housing which is substantially in the shape of a rectangular box, open at the top thereof, a removable top plate which is supported upon an upper part of the housing such as to leave an exposed portion of rear part of the open top of the housing, to serve as an air inlet/outlet aperture, and a cover disposed over the air inlet/outlet aperture. The top plate is retained at the front end thereof by a catch member which is adapted to engage with a corresponding catch member provided at the front of the housing, and is fixedly attached at the rear end thereof to the housing by means of screws. These screws are concealed by the cover which is disposed over the air inlet/outlet aperture. With such configuration, the screws which attach the top plate are concealed by this cover, so that they do not adversely affect the appearance of the cooking stove. Furthermore, when it is necessary to remove the top plate, e.g. in order to service the interior of the cooking stove, then since the front end of the top plate is held retained by the mutually engaged catch members, and only the rear end of the top plate is fixedly attached by screws, the top plate can be easily and rapidly removed from the cooking stove.

DETAILED DESCRIPTION

Figure 1:
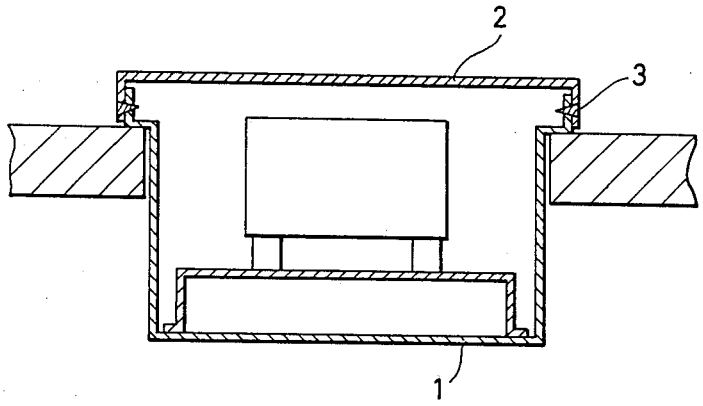
FIG. 1 PRIOR ART
FIG. 1 is a cross-sectional view of an example of an electric cooking stove according to the prior art.

Before describing an embodiment of the present invention, problems which arise in the prior art will be described with reference to FIG. 1, which is a cross-sectional view showing a prior art arrangement for attaching a top plate of an electric cooking stove or gas range which is of drop-in type and is designed to fit within a counter top. As shown, the stove is supported around the upper periphery of a housing 1, while a stove top plate 2 formed in the shape of an inverted tray is fixedly attached to the housing at opposite sides thereof by means of screws 3. With such an arrangement, if there is a wall surface close to the cooking stove position, it may be difficult or even impossible to insert screws 3 to attach top plate 2 and to subsequently remove screws 3 when top plate 2 must be removed for maintenance etc. In addition, due to the fact that the top plate 2 protrudes upward from the counter top by a substantial amount, such a design is inconvenient for the user and unattractive in appearance.

Another method of attaching a top plate of a cooking stove is to utilize screws positioned at the four corners of the top plate, with the screws being inserted downward. However such an arrangement will adversely affect the appearance of the stove, since these attachment screws will be highly visible from the exterior of the stove. In addition, it is necessary to remove all of these screws when the top plate must be removed for servicing the interior of the cooking stove, which is inconvenient and time-consuming.

Figure 2:
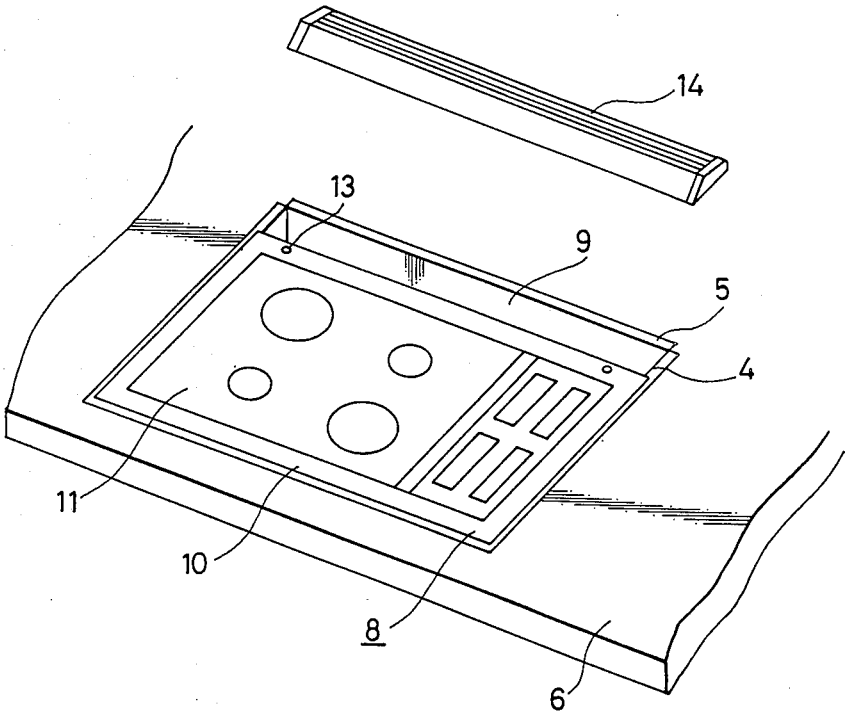
FIG. 2 is a general oblique view of an embodiment of an electric cooking stove according to the present invention.
Figure 3:
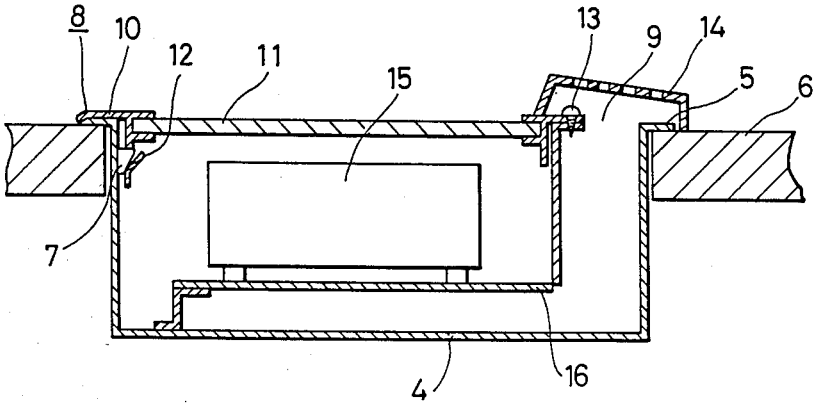
FIG. 3 is a cross-sectional view of the embodiment of FIG. 2.
Figure 4:
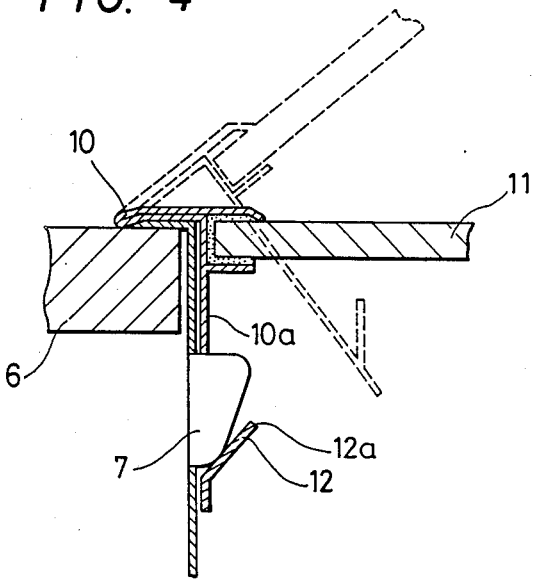
FIG. 4 is an expanded cross-sectional view of the major components of the embodiment of FIG. 2.

An embodiment of an electric cooking stove according to the present invention will now be described, with reference to in FIGS. 2 to 4. Reference numeral 4 denotes a housing, which is box-shaped and is open at the top. A flange 5 is formed around the upper periphery of housing 4, for supporting housing 4 within a counter top 6. A catch member 7 is provided on the inner face of the front side of housing 4, positioned near substantially centrally the top of that inner face, protruding towards the interior of housing 4. A removable top plate 8 is mounted on the open top of housing 4, with an air inlet/outlet aperture 9 being formed in the top of housing 4 between top plate 8 and the rear of housing 4. Housing 4 also includes an internally disposed ventilation partitioning member 16, which is of L-shaped configuration, for providing an air flow passage between the air inlet/outlet aperture 9 and the interior of the cooking stove. The top plate 8 is formed of a frame 10 and a plate member 11, with frame 10 having an approximately T-shaped cross-section. A catch member 12 is provided on the front vertical side of frame 10, positioned in correspondence with catch member 7 of housing 4 and protruding towards the interior of housing 4 in an upwardly sloping direction. The catch member 12 essentially consists of a strip **12*a* which has been partially cut out from a front, vertically oriented side wall 10*a* of the frame 10 and then bent into the upwardly sloping shape shown in FIG. 4, i.e. sloping upward with respect to the surface of side wall 10***a* of frame 10 when top plate 8 is mounted normally. As is clear from FIG. 4, when top plate 8 is mounted on housing 4 with plate member 11 horizontally disposed, the positions of catch members 7 and 12 and the angle at which strip 12 slopes upward are such that the engagement between catch member 12 of frame 19 and catch member 7 of housing 4 acts to pull top plate 8 in a downward direction, to thereby retain top plate 8 in a fixed position with respect to housing 4. In addition, the rear end of top plate 8 is fixedly attached to partitioning member 16 by means of two screws 13. Reference numeral 14 denotes a removable cover which is disposed on the air inlet/outlet aperture 9, and which serves to conceal the screws 13 of top plate 8. Reference numeral 15 denotes a heater unit which may include, for example, a heating coil, etc.

With a cooking stove having the configuration described above, top plate 8 and housing 4 are attached together by means of screws 13, at the rear, and are mutually engaged at the front by means of catch member 12 and catch member 7 of housing 4. The top surface of top plate 8 is substantially co-planar with the upper surface of the counter top 6, which is extremely convenient for the user, i.e. with regard to cleaning, etc., and provides an attractive appearance. In addition, although the top plate 8 and housing 4 are attached by means of screws 13, these screws are concealed by cover 14 of air inlet/outlet aperture 9. Thus, screws 13 do not adversely affect the appearance of the cooking stove. Furthermore, when top plate 8 has to be removed, for maintenance or other purposes, then it is only necessary to remove cover 14 from the air inlet/-outlet aperture 9 and then remove screws 13 which attach top plate 8 to housing 4. The rear end of top plate 8 can then be raised into the position shown by the broken-line outline portion of FIG. 4, thereby disengaging the catch member 7 at the front of housing 4 from the catch member 12 of top plate 8. The top plate 8 can then be easily removed.

With the embodiment described above, the top plate is disposed towards at the front of the cooking stove, while the air inlet/outlet aperture is disposed at the rear of the stove. However it is equally possible to arrange that the air inlet/outlet aperture is disposed at the front of the cooking stove, or on each side of the stove, while retaining the advantages of the present invention.

Although the present invention has been described in the above with reference to a specific embodiment, it should be noted that various changes and modifications to the embodiments may be envisaged, which fall within the scope claimed for the invention as set out in the appended claims. The above specification should therefore be interpreted in a descriptive and not in a limiting sense.

What is claimed is:

1. A cooking stove comprising:

a box-shaped housing having an open top and sides;

a top plate removably mounted upon an upper portion of said housing such as to form an air inlet/outlet aperture between at least one end of said top plate and said housing, said top plate comprising a peripherally disposed frame which is of T-shaped cross-sectional configuration including an inner peripheral portion, an outer peripheral portion and at least one depending side wall, and a flat plate member which is fixedly retained within said inner peripheral portion of said frame, said outer peripheral portion of said frame being disposed upon said upper portion of said housing for supporting said top plate thereon;

first catch means formed on one of said sides of the interior of said housing, and second catch means formed on said side wall of said top plate, said first and second catch means being adapted to removably attach said top plate to said housing; and a cover member dimensioned to cover said air inlet/-outlet aperture.

2. A cooking stove according to claim 1, further comprising at least one screw mounted at the opposite side of said top plate to said second catch means for attaching said top plate to said housing.

3. A cooking stove according to claim 2, wherein said cover member is positioned to cover said screw.

4. A cooking stove according to claim 1, wherein said first catch means comprises a first catch member formed of an inwardly extending protruding portion of said housing and in which said second catch means comprises a second catch member formed of a partially cut-out strip of a vertical portion of said frame side wall, said strip being shaped to slope upward with respect to a vertical surface of said vertical portion of said frame, with the angle of said slope and the position of said strip being selected such that said strip can engage with said protruding portion of said housing in a manner acting to retain said top plate with respect to said housing.

5. A cooking stove according to claim 1, wherein said housing further comprises an internal partitioning member forming a ventilation duct leading to said air inlet/-outlet aperture.

6. A cooking stove according to claim 5, further comprising at least one screw disposed at the opposite side of said top plate to said second catch means, for attaching said top plate to said internal partitioning member and also for attaching said top plate to said housing.

* * * * *